US007213380B2

(12) United States Patent
Justice

(10) Patent No.: US 7,213,380 B2
(45) Date of Patent: May 8, 2007

(54) CONCRETE SLAB LIFTER

(76) Inventor: Gary A Justice, 1676 E. Lochmeadow Ct., Meridian, ID (US) 83642

( * ) Notice: Subject to any disclaimer, the term of this patent is extended or adjusted under 35 U.S.C. 154(b) by 33 days.

(21) Appl. No.: 11/128,504

(22) Filed: May 12, 2005

(65) Prior Publication Data

US 2006/0272276 A1 Dec. 7, 2006

(51) Int. Cl.
*E04G 21/14* (2006.01)

(52) U.S. Cl. ..... 52/749.1; 280/47.27; 414/453

(58) Field of Classification Search ..... 52/749.1, 52/747.1; 404/73, 90; 414/453, 454; 280/47.24, 280/47.27, 47.28, 47.29
See application file for complete search history.

(56) References Cited

U.S. PATENT DOCUMENTS 384,078 A 6/1888 Roche
2,086,318 A 7/1937 Jackson
2,329,439 A * 9/1943 Leif ..... 414/453
2,650,786 A * 9/1953 Platt ..... 410/51
2,710,106 A 6/1955 Hanson
3,358,863 A * 12/1967 Griffith et al. ..... 414/491
3,980,190 A 9/1976 Paterson
5,017,080 A * 5/1991 Thorndike et al. ..... 414/454
6,131,927 A * 10/2000 Krawczyk ..... 280/47.29
6,682,049 B2 1/2004 Thompson

* cited by examiner

*Primary Examiner*—Naoko Slack
*Assistant Examiner*—William Gilbert
(74) *Attorney, Agent, or Firm*—Pedersen & Co., PLLC; Ken J. Pedersen; Barbara S. Pedersen

(57) ABSTRACT

A concrete slab lifter is disclosed, wherein the concrete slab lifter comprises a central support, a bottom plate attached to the bottom of the central support, a pair of wheels attached near the bottom of the central support, a jaw pivotally attached to the central support, and a handle attached to the top of the central support. The jaw is configured to slide along the central support and comprises a first member attached to the central support and configured to lock in a position flush against the central support, a second member attached perpendicularly to the first member, and a tooth comprising a sharpened plate attached perpendicularly to the second member.

20 Claims, 11 Drawing Sheets

CONCRETE SLAB LIFTER

BACKGROUND OF THE INVENTION

1. Field of the Invention

The present invention relates to systems and methods of removing concrete.

2. Related Art

Concrete floors are generally between four and twelve inches thick. When removing concrete flooring, there are two alternative approaches. The first is to saw trenches into the concrete so that the concrete is cut into rectangular slabs between eighteen and forty-eight inches long in a grid-like pattern. Each piece, which can weigh up to five hundred pounds, must be pried off the ground, lifted by hand, and then placed on a dolly to be removed from the site. This requires the laborer to get his fingers under one end of the slab, lift that end up off of the ground, and roll the slab onto the dolly. Two laborers are generally required to roll the slab onto the dolly.

The second approach is to break the concrete floor into many small pieces and then remove the pieces from the site. This requires the laborer to make many trips with the pieces. It also produces small chunks and dust which are difficult to remove, making it difficult to leave the workplace clean after the concrete floor has been removed.

SUMMARY OF THE INVENTION

The present invention is a mechanical device used to grab, lift, and transport slabs of concrete comprising a central support member, a bottom plate, and a jaw which clamps the concrete slab between the jaw and the bottom plate.

BRIEF DESCRIPTION OF THE DRAWINGS

The accompanying drawings illustrate several aspects of embodiments of the present invention. The drawings are for the purpose only of illustrating preferred modes of the invention, and are not to be construed as limiting the invention.

DESCRIPTION OF THE PREFERRED EMBODIMENTS

Figure 1:
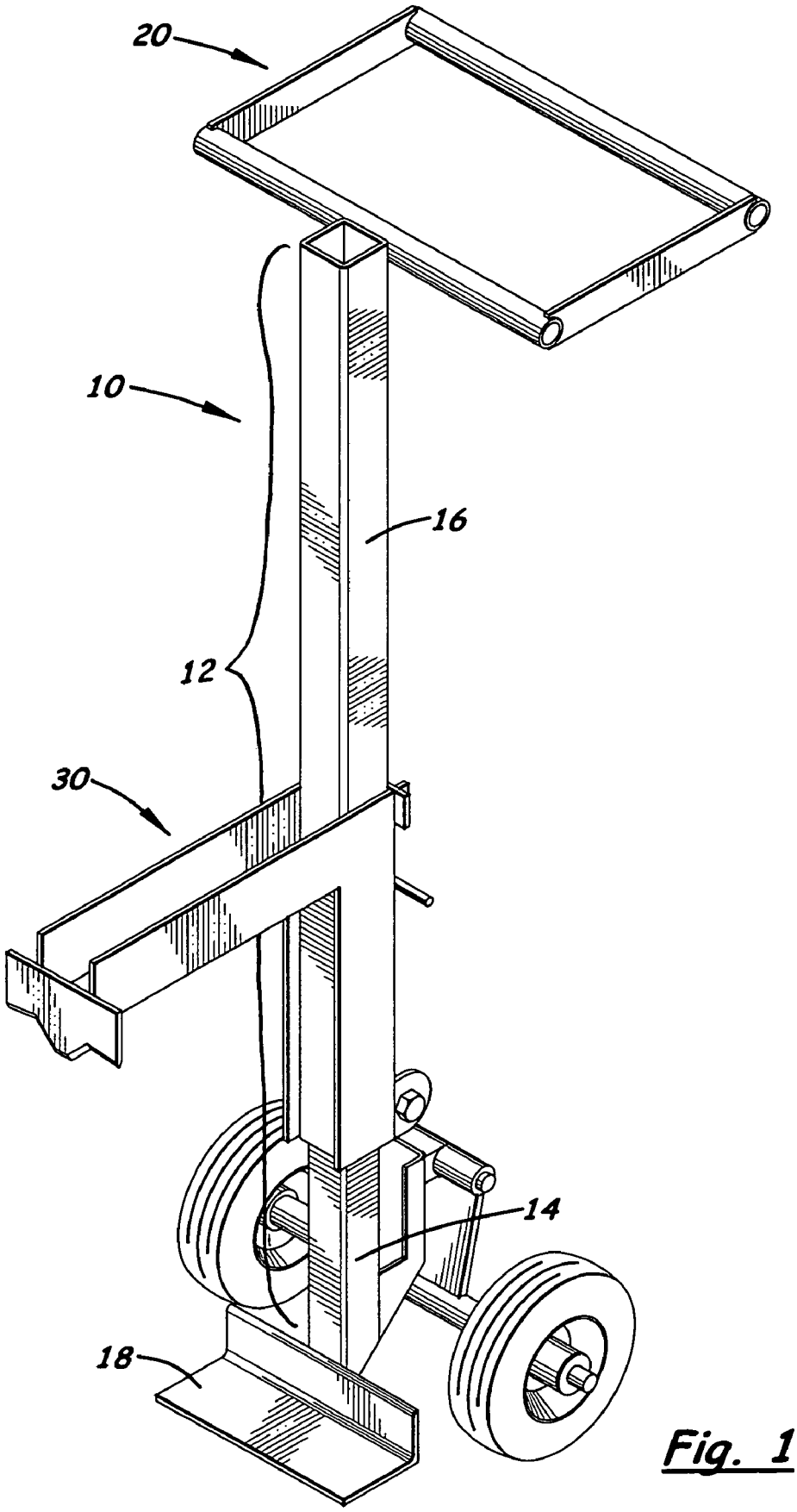
FIG. 1 is a front perspective view of the preferred embodiment of the present invention in the upright, locked position with the wheels in the lowered position.

The preferred embodiment of the concrete slab lifter 10 is utilized to lift and remove concrete slabs that have been cut from a concrete floor into slabs between eighteen and forty-eight inches long in a grid-like pattern.

The preferred embodiment of the concrete slab lifter 10 comprises a central support 12, a handle 20 attached to a top end of the central support 12, a bottom plate 18 extending generally perpendicularly from at or near the bottom end of the central support 12, a pair of wheels 50 attached near the bottom of the central support 12, and a jaw 30 which is attached to the central support 12 in such a manner as to allow the jaw 30 to pivot in plane parallel to the central support 12, which is a vertical plane when the concrete slab lifter 10 is in an upright position. The extension of the bottom plate 18 from the central support 12 is preferably shorter than the thickness of the concrete slab 5, that is, between three and ten inches for lifting concrete slabs between four and twelve inches thick, to enable the bottom plate 18 to extend along an end of the concrete slab 5, but not extend past the end of the concrete slab 5 and abut against the ground 1. More than one bottom plate 18 could be used, so long as they were collectively strong enough to support the weight of a concrete slab 5. The parts, except for the wheels 50, are preferably made of steel because of its strength; however, aluminum could also be used, which would have the benefit of being lighter in weight. It is envisioned that other materials, those materials preferably being metal, could be used.

The jaw 30 and the central support 12 are attached in such a manner as to enable an operator to vary the distance between the jaw 30 and the bottom plate 18. The preferred means is a telescoping system as follows. The central support 12 is comprised of an inner tube 14 and an outer tube 16. The bottom plate 18 is attached to a bottom end of the inner tube 14. The outer tube 16 is placed on top of and around the inner tube 14 so that, with the inner tube 14 in a stationary position, the outer tube 16 can slide along the inner tube 14, varying the length of the central support 12. The length of the central support 12 may be fixed by passing a set screw 13 through threads in the outer tube 16, creating a friction fit between the set screw 13 and the inner tube 14; a pin or other fasteners could be used. The shape of the outside surface of the inner tube 14 should correspond to the inside surface of the outer tube 16 so that the outer tube 16 will fit over the inner tube 14; however, neither the outer tube 16 nor the inner tube 14 should be in the shape of a circle, which would allow the outer tube 16 to swivel about the inner tube 14. The preferred shape is a square. The jaw 30 is attached to the outer tube 16, causing the distance between the jaw 30 and the bottom plate 18 to vary when the outer tube 16 slides along the inner tube 14.

The jaw 30 is generally u-shaped, and comprises a longitudinal leg which pivotally connects to the central support 12 and extends along the central support 12 typically about one-third to two-thirds the length of the concrete slab 5 to be lifted, a transverse leg which extends generally transverse to the central support 12 and generally parallel to the bottom plate 18, and a gripping leg or "tooth" that extends generally parallel to the longitudinal leg and generally perpendicular to the bottom plate 18.

Figure 2:
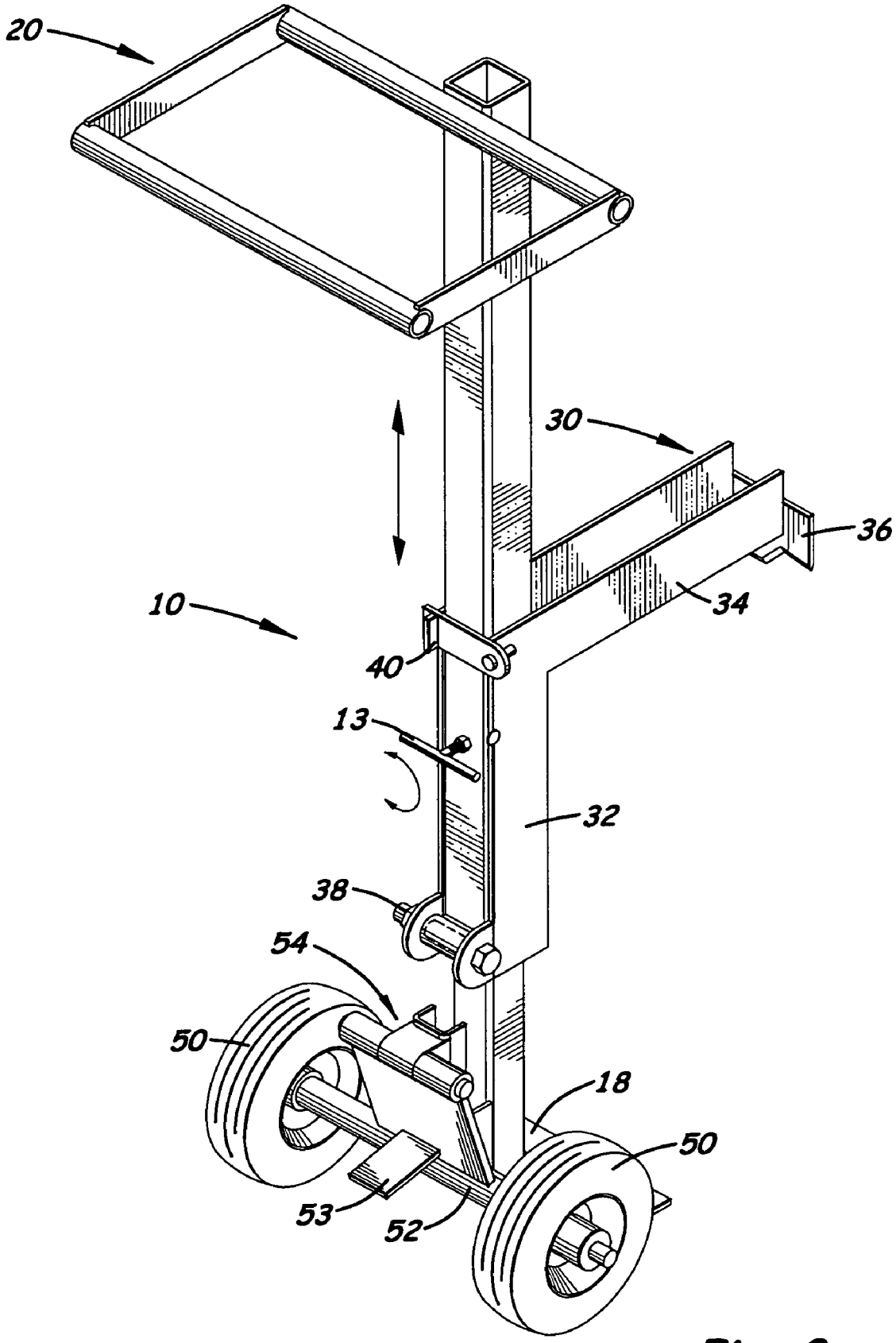
FIG. 2 is a rear perspective view of the preferred embodiment of the present invention in the upright, locked position with the wheels in the lowered position.
Figures 3, 4:
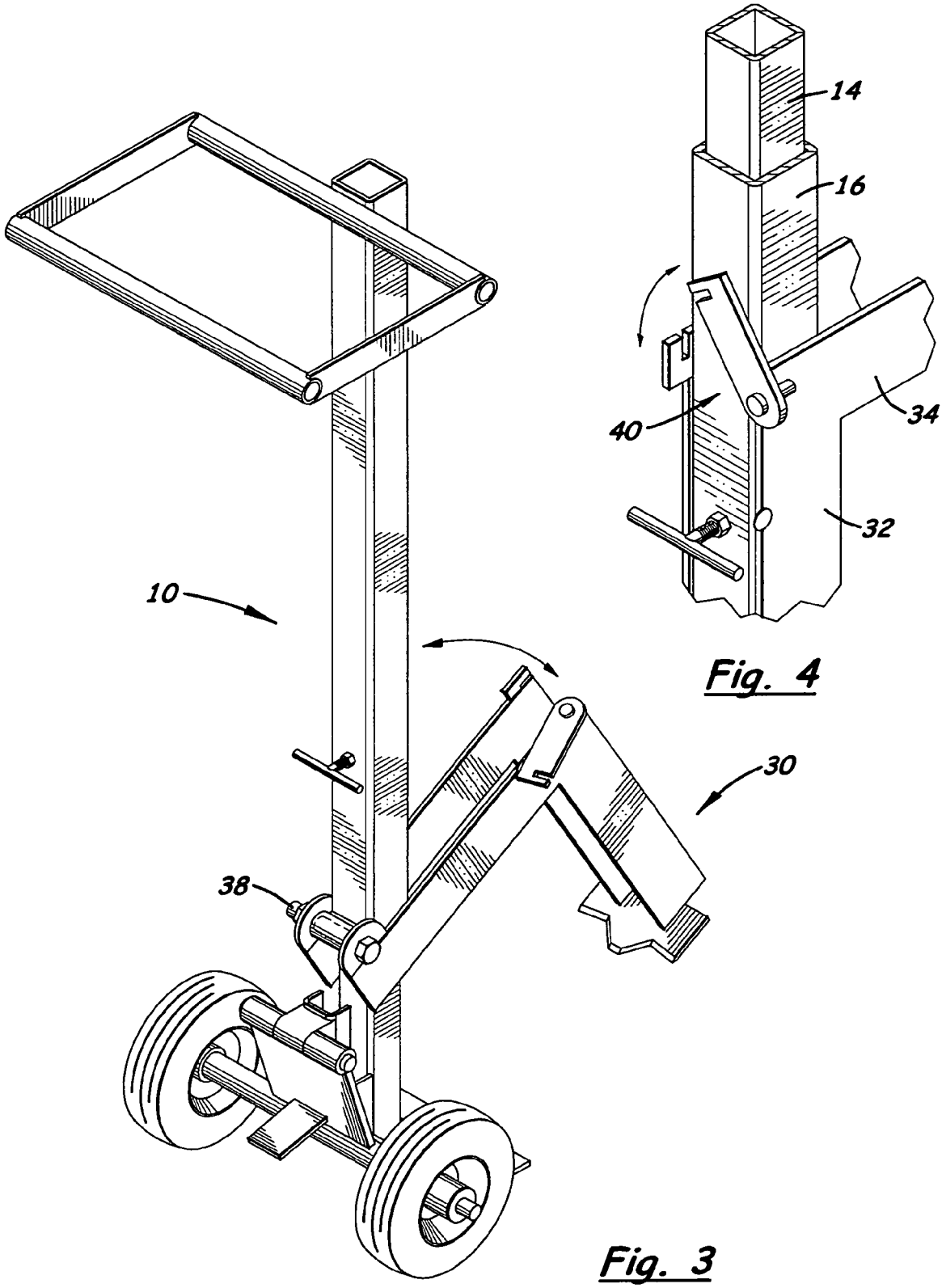
FIG. 3 is a rear perspective view of the preferred embodiment of the present invention with the jaw unlocked from the central support.
FIG. 4 is a rear perspective view of part of the preferred embodiment of the present invention showing the latch unlocking the jaw from the central support.
Figure 7:
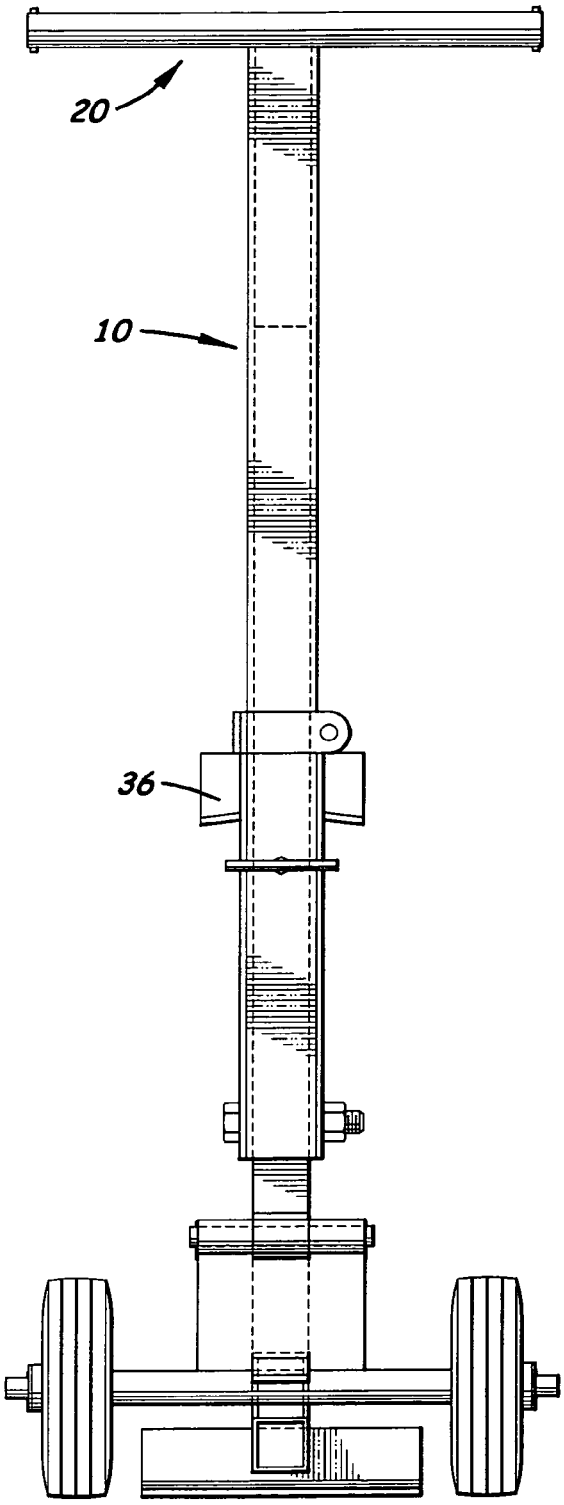
FIG. 7 is a rear view of the preferred embodiment of the present invention in the upright, locked position.

In the preferred embodiment, the jaw 30 is preferably comprised of a first member 32, a second member 34, and a tooth 36. The preferred means of pivotal connection between the first member 32 and the outer tube 16 is a bolt 38 which passes through a pair of holes in each of the first member 32 and the outer tube 16; the bolt 38 is held in place with a nut. The first member 32 may be locked flush against the outer tube 16, preferably by means of a latch 40, as shown in FIGS. 2, 4, and 7. The second member 34 preferably extends perpendicularly from the first member 32. The inner surface 34' of the second member 34 is preferably flat to enable the inner surface 34' to extend across the end of the concrete slab 5. The tooth 36 extends from the second member 34 in a direction parallel to the first member 32 toward the bottom of the central support 12. The tooth 36 should be a metal plate that is preferably not more than one-half an inch thick and is sharp at the distal end to enable it to slide between a concrete slab 5 and the ground 1 upon which the concrete slab 5 rests. The tooth 36 should extend from the second member 34 at least one inch, and preferably two inches, to enable the tooth 36 to grab the concrete slab 5. The distance between the tooth 36 and the first member 32 is preferably thirteen inches for lifting concrete slabs that are twelve inches thick; a jaw with a distance of four-and-one-half inches is preferred for the thinnest four-inch slabs. More than one tooth 36 could be used; however, a single tooth 36 is preferred because the operator must slide the tooth 36 between a concrete slab 5 and the ground 1, and more than one tooth 36 would make this task more difficult. It is envisioned that interchangeable jaws will allow a user to utilize a jaw appropriate to the thickness of the concrete to be removed.

An alternative means of configuring the jaw 30 and central support 12 is for the central support 12 to be comprised of a larger bottom tube with two slots, and for the jaw 30 to be attached to a smaller top tube by a pivot pin. The smaller top tube slides into the larger bottom tube. The pivot pin rides in the two slots on opposite sides of the larger bottom tube; the ends of the slots create limits to how far the pin, and therefore, the smaller top tube, can slide. A set screw is inserted into threads in the larger bottom tube to create a friction fit with the smaller top tube. The handle is then attached to the smaller top tube. However, this embodiment is more difficult to manufacture, and is therefore less preferred.

Figures 5, 6:
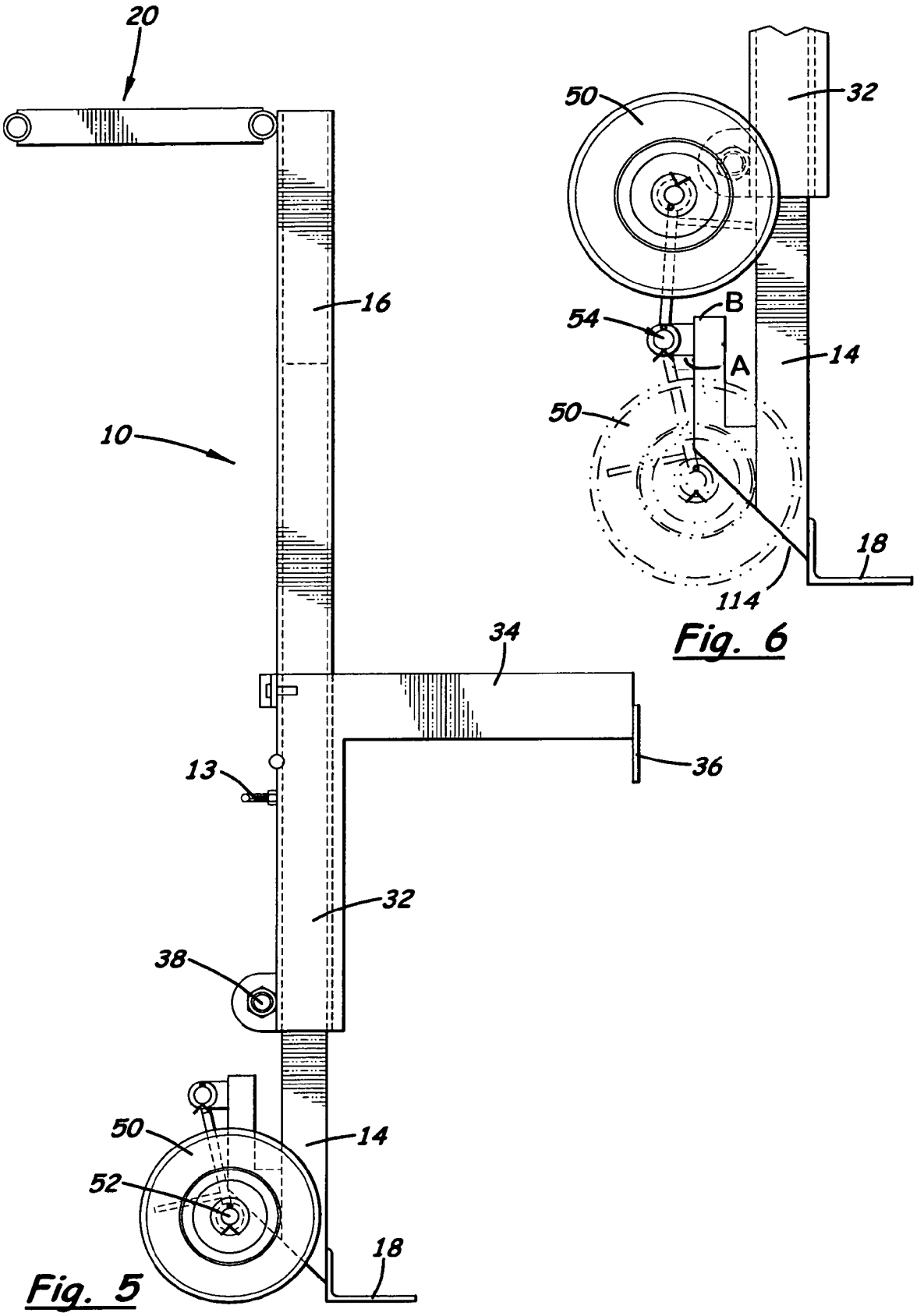
FIG. 5 is a side view of the preferred embodiment of the present invention in the upright, locked position and the wheels in the lowered position.
FIG. 6 is a side view of part of the preferred embodiment of the present invention showing the wheels swiveling between two positions against the central support.
Figure 13A:
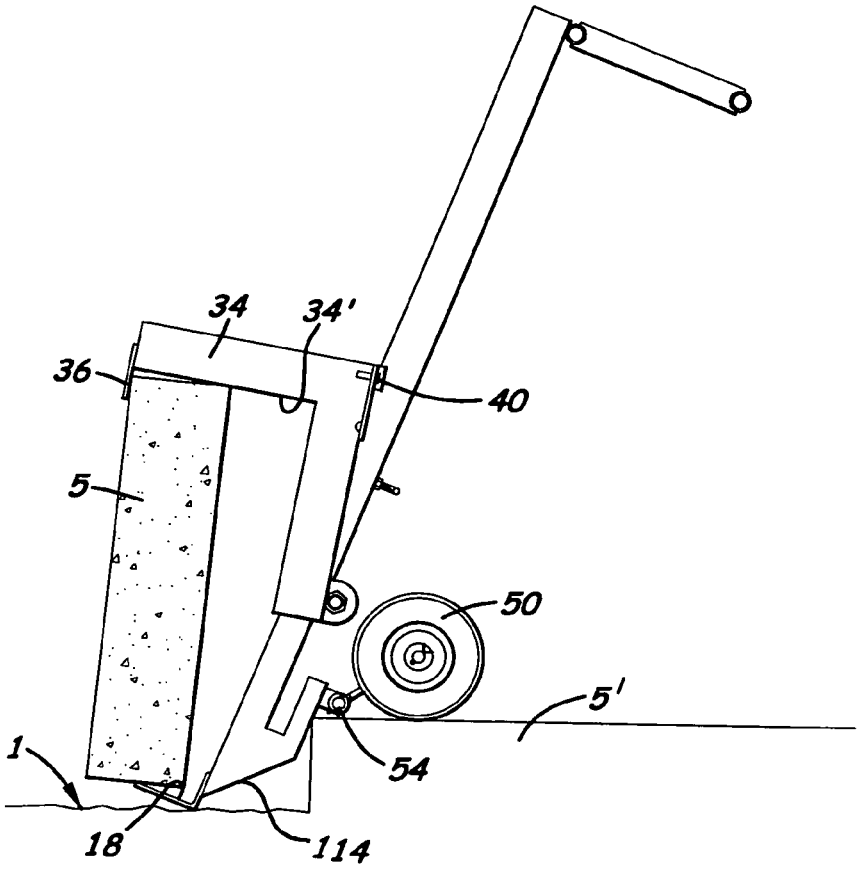
FIG. 13A shows the preferred embodiment of the present invention as it is being used to lift the concrete slab off of the ground after the wheels have pivoted upward relative to the central support.

The axle 52 of the wheels 50 is preferably connected to the inner tube 14 by means of a hinge 54 in such a manner as to allow the wheels 50 to pivot from a first lowered position in which they extend down as far as or past the bottom plate 18, enabling an operator to move the concrete slab lifter 10 by tipping the concrete slab lifter 10 back a small amount and rolling the concrete slab lifter 10 along the wheels 50, to a second raised position in which the wheels 50 will touch the ground 1 only when the concrete slab lifter 10 is nearly parallel to the ground 1, as shown in FIG. 6, or when the concrete slab lifter 10 is being removed from the space vacated by the concrete slab 5, as shown in FIG. 13A. A kickstop 53 is connected to the axle 52 to enable the operator to keep the wheels 50 in their lowered position as the concrete slab lifter 10 is tilted backward.

Figure 9:
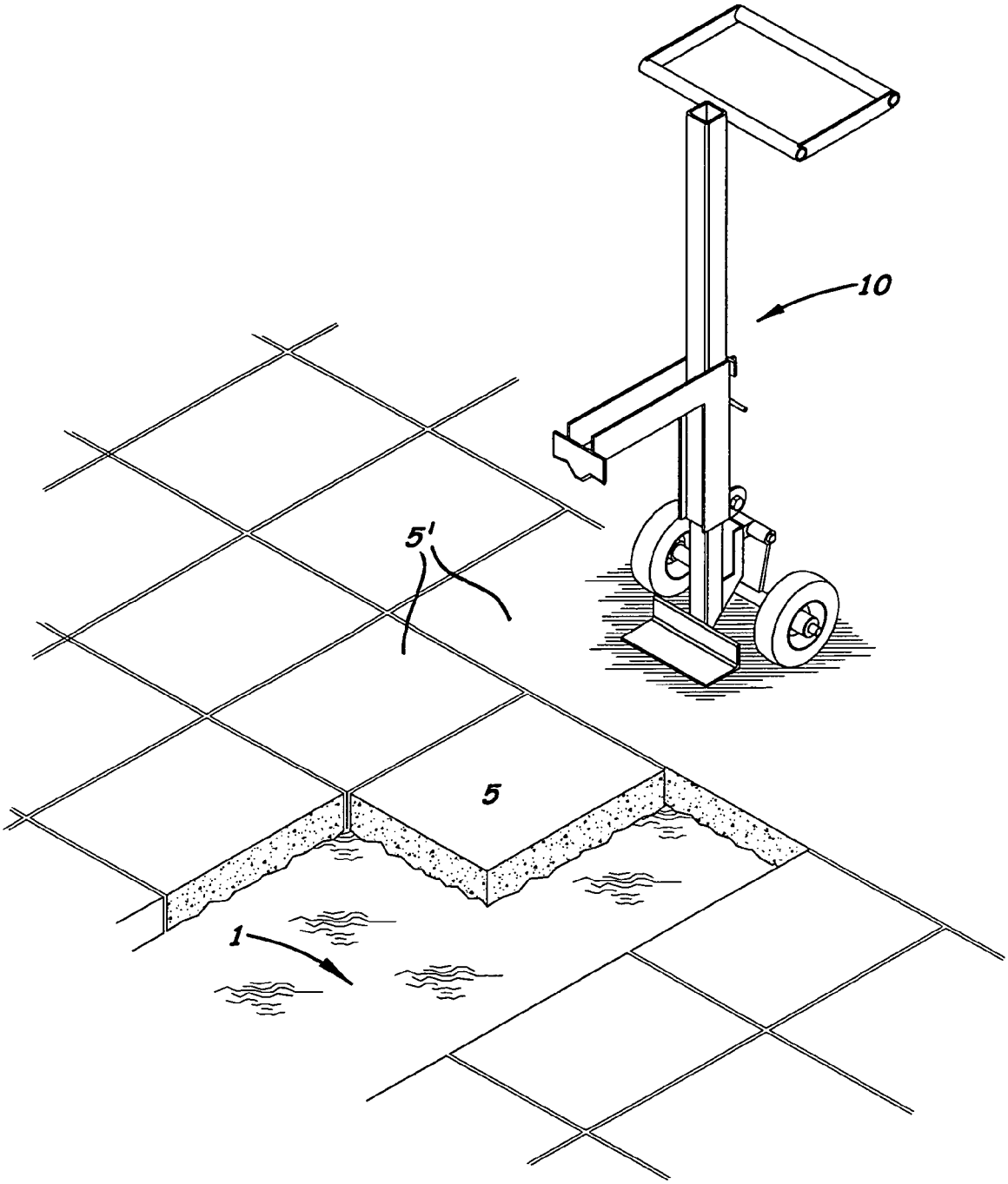
FIG. 9 shows the preferred embodiment of the present invention at a workplace with trenches cut into the concrete floor to form a grid of rectangular concrete slabs.
Figure 10:
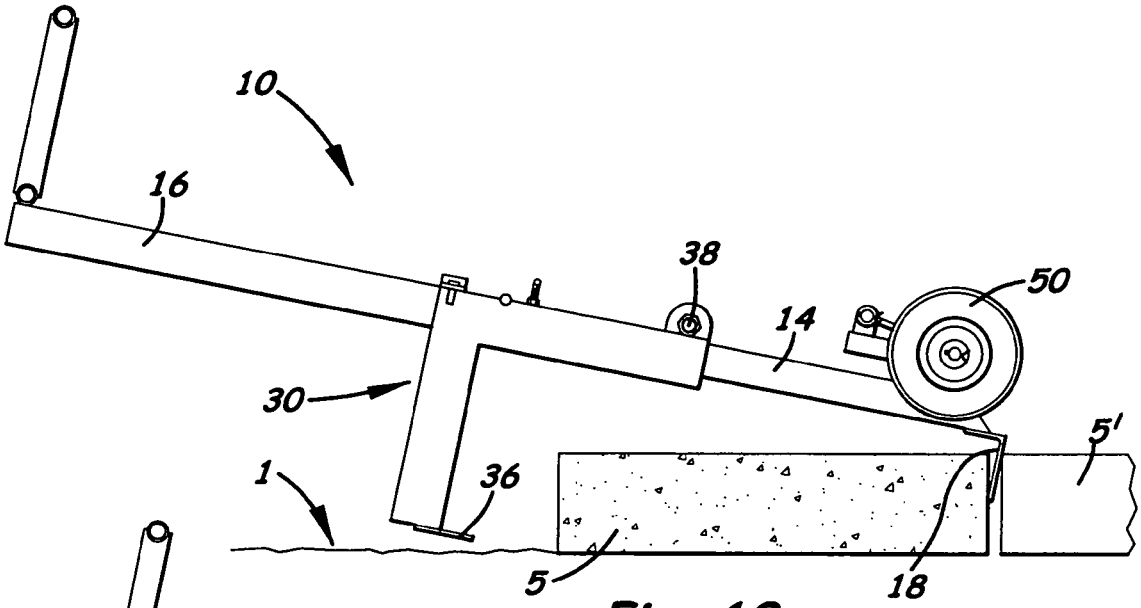
FIG. 10 shows the preferred embodiment of the present invention being lowered to lift a concrete slab with the base plate pressing against one end of the concrete slab and the jaw in the locked position.

The use of the concrete slab lifter 10 is shown in FIGS. 9–17. The concrete slab lifter 10 is wheeled to the concrete slab 5 that is to be removed, as shown in FIG. 9. There should be an open space at one end of the concrete slab 5; this may require that the first concrete slab in a row be removed by hand. With the jaw 30 locked along the outer tube 16, the bottom plate 18 is placed flush along one end of the concrete slab 5, and the central support 12 extends across or near the top of the concrete slab 5, as shown in FIG. 10. The jaw 30 is kept in the locked position to enable the operator to precisely control the tooth 36. If the jaw 30 were unlocked, then the jaw 30 would fall into a lowered, closed position before being properly positioned around the concrete slab 5, and would not be able to grab the concrete slab 5. With the jaw 30 locked, the jaw 30 is open, enabling the concrete slab 5 to fit between the bottom plate 18 and the second portion 34.

Figure 8:
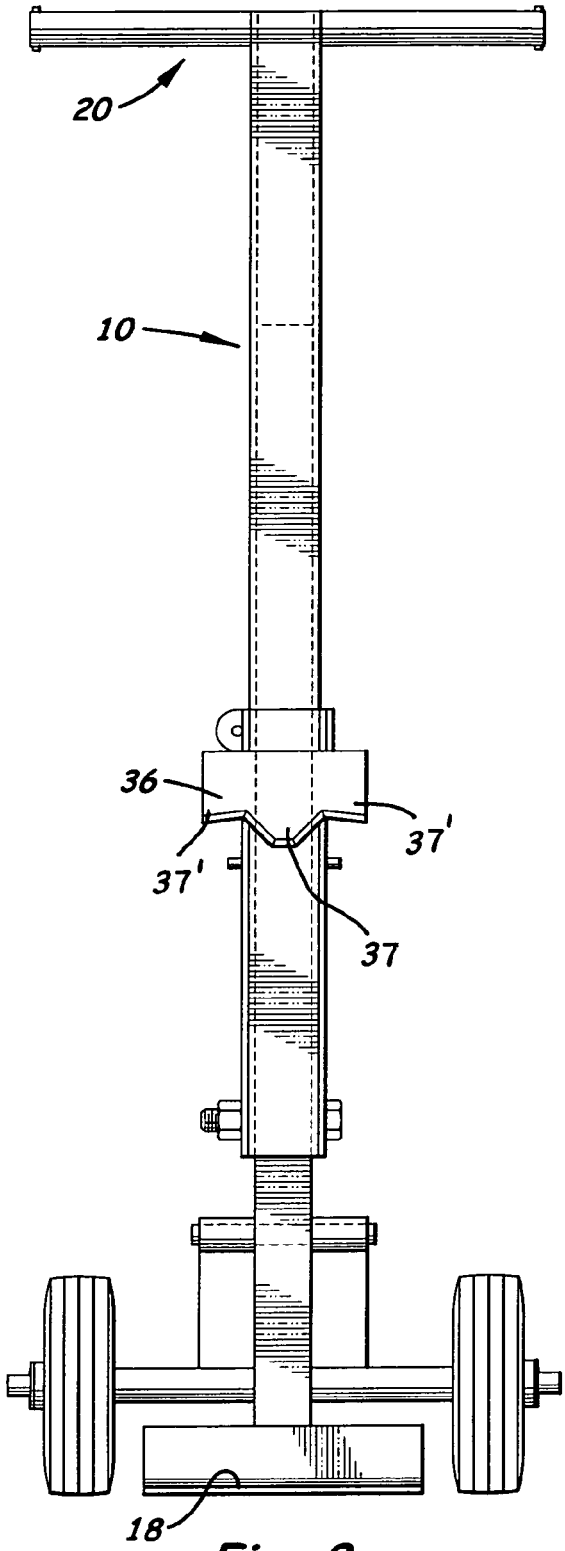
FIG. 8 is a front view of the preferred embodiment of the present invention in the upright, locked position.
Figure 11:
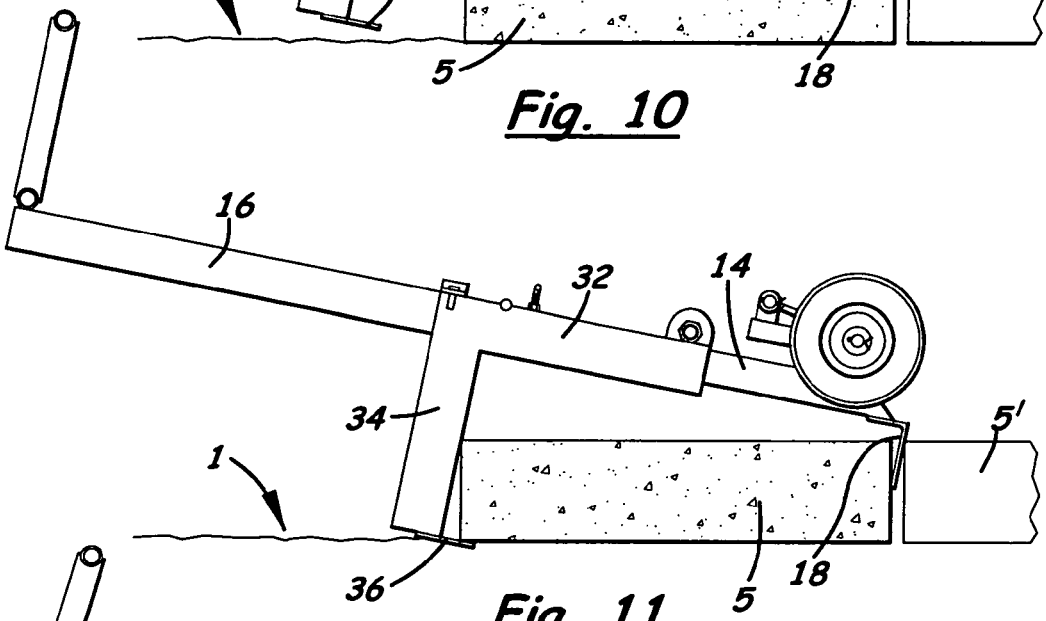
FIG. 11 shows the preferred embodiment of the present invention with the bottom plate pressed against one end of the concrete slab and central support being shortened to slide the tooth under the opposite end of the concrete slab, but the jaw still locked against the central support.

Between FIGS. 10 and 11, the set screw 13 is loosened to allow the outer tube 16 to slide along the inner tube 14. The operator shortens the central support 12 to place the tooth 36 at the point of contact between the ground 1 and the concrete slab 5 at the end of the concrete slab 5 with open space. The operator applies force to the handle 20 to shorten the central support 12, forcing the tooth 36 to dig under the concrete slab 5, as shown in FIG. 11. The ability to vary the length of the central support 12 enables the concrete slab lifter 10 to be used on concrete slabs 5 of different lengths, and enables the tooth 36 to dig in between the concrete slab 5 and the ground 1. The tooth 36, which is preferably two inches long, preferably comprises a center tooth 37 and two wing teeth 37', as shown in FIGS. 1, 3, and 8. The center tooth 37 preferably extends farther from the second portion 34 than the wing teeth 37', and the center tooth 37 is most frequently used to grip concrete slabs. The wing teeth 37' enable the concrete slab lifter 10 to lift slabs with ends that are not parallel, that is to say, slabs that are not rectangular in shape, because even if the edge of the concrete slab 5 were not flush against the inner surface 34' of the second portion 34, the wing tooth 37' would still be able to extend underneath enough of the concrete slab 5 to lift the concrete slab 5. The sharp edge of the tooth 36 enables the tooth 36 to dig in between the concrete slab 5 and the ground 1.

The length of the first portion 32 is preferably between one-third and two-thirds, and most preferably about half, the length of the concrete slab 5 to be lifted. This places the point of pivotal connection between the jaw 30 and the central support 12 near the center of gravity of the concrete slab 5, and maximizes the operator's ability to control and lift the concrete slab 5. Preferably, the central support 12 extends out beyond the jaw 30 for leverage; the total length of the central support 12 with the jaw 30 clamping the concrete slab 5 is preferably between one-and-one-half and two-and-one-half times the length of the concrete slab 5, so that the effective lever arm is between three and five times as long as the distance between the pivot point and the center of gravity of the concrete slab 5. If the first member 32 were shorter than one-third the length of the concrete slab 5, then the point of pivotal connection would be so far above the center of gravity of the concrete slab 5 that the jaw 30 would easily pivot open while grasping the concrete slab 5, and the concrete slab 5 would be liable to slip out of the concrete slab lifter 10. If the first member 32 were longer than two-thirds the length of the concrete slab 5, then the point of pivotal connection, which is the point on the central support 12 which bears the load of the concrete slab 5, would be so low that the torque would cause a risk of bending the central support 12, rendering the concrete slab lifter 10 inoperable. For lifting concrete slabs 5 between eighteen and forty-eight inches long, the first portion 32 is preferably between six and thirty-two inches long, and most preferably twelve inches long.

Figure 12:
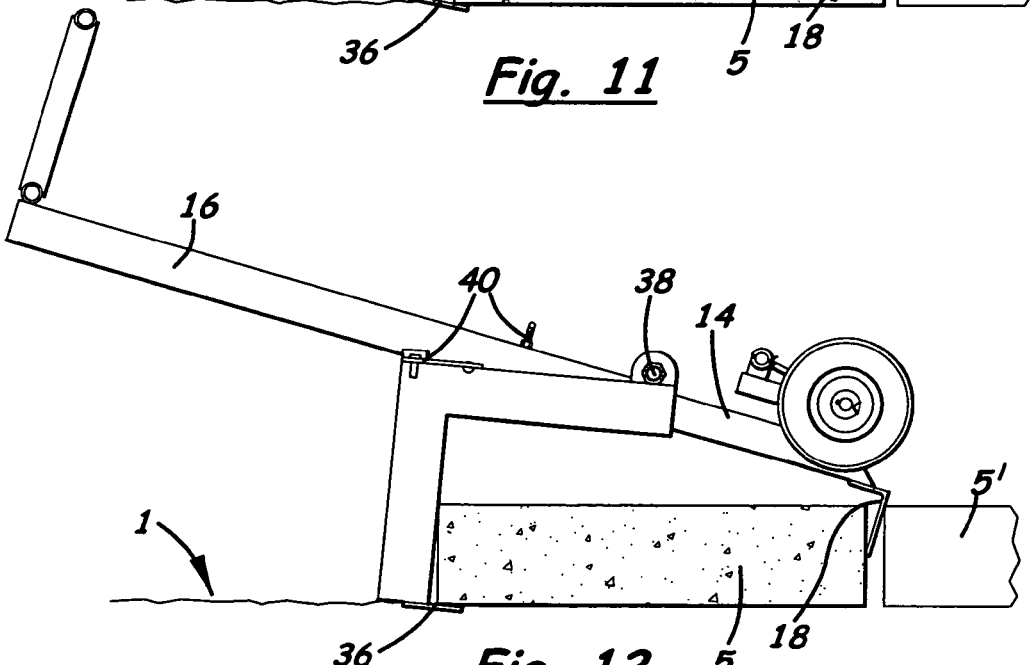
FIG. 12 shows the preferred embodiment of the present invention with the jaw unlocked from the central support, the handle end being raised, and the concrete slab still on the ground but being tightly clamped between the bottom plate and the jaw.

When the tooth 36 is under the concrete slab 5, the latch 40 is released, unlocking the jaw 30 from the outer tube 16. As the handle 20 connected to the central support 12 is pulled up away from the ground 1, gravity causes the jaw 30 to pivot toward the ground 1 so that the first member 32 is no longer flush with the outer tube 16, and the distance between the union of the tooth 36 and second member 34, and the bottom plate 18, is decreased, clamping the concrete slab 5 in place, as shown in FIG. 12. The weight of the concrete slab 5 increases the clamping pressure of the jaw 30 when the operator begins lifting the concrete slab lifter 10 to the vertical position. The concrete slab 5 can then be lifted away from the ground 1 utilizing the benefit of the handle 20 for gripping and the torque created by the length of the central support 12. Prior to lifting the concrete slab lifter 10, the set screw 13 is tightened to fix the length of the central support 12, allowing an operator to pull on the handle 20 without loosening the grip on the concrete slab.

As the operator lifts the concrete slab lifter 10 and concrete slab 5 from the position shown in FIG. 12 by means of the handle 20, the concrete slab lifter 10 may pivot at the point of contact between the bottom plate 18 and the adjacent slab 5'. The bottom plate 18 pushes the concrete slab 5 out away from the adjacent slab 5' and the bottom plate 18 and bottom end of the concrete slab lifter 10 move into the space being vacated by the concrete slab 5, pivoting on the end surface of the slab 5 and the bottom plate 18 to reach the position shown in FIG. 13A. The support structure and hinge connecting the wheels to the central support 12 should be configured to avoid contact with, or at least avoid becoming hung-up on, the slab 5' during pivoting of the lifter 10 on slab 5 and plate 18 in the vacated space. For example, this may include lower surface 114 slanting upwards to avoid contact with the slab 5'. The hinge 54 may be located several inches (preferably 2–5) higher on the lifter than the thickness of the slab 5' to keep the hinge away from the slab 5' (in other words, providing a distance from the plane of the plate 18 to the parallel plane through the hinge 54 that is preferably 2–5 inches greater than the thickness of the slab 5'). Also, or alternatively, the hinge 54 may be located at or near location B in FIG. 6, to change or eliminate the angle A in FIG. 6.

Figure 13B:
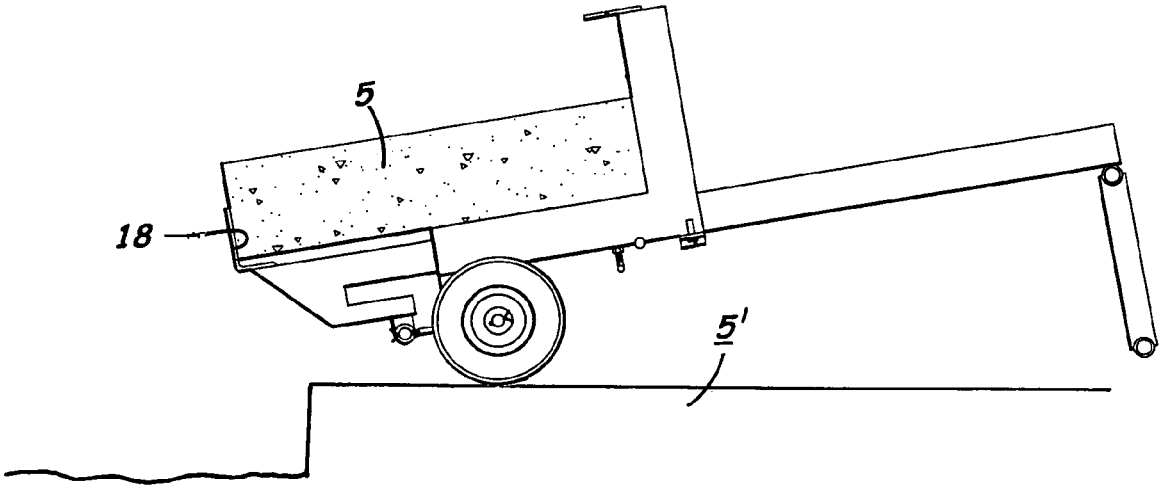
FIG. 13B shows the preferred embodiment of the present invention pivoted into a nearly horizontal position to be rolled along and off of the adjacent concrete slab, after the lifted concrete slab has pivoted rearward onto or near the central support.
Figure 14:
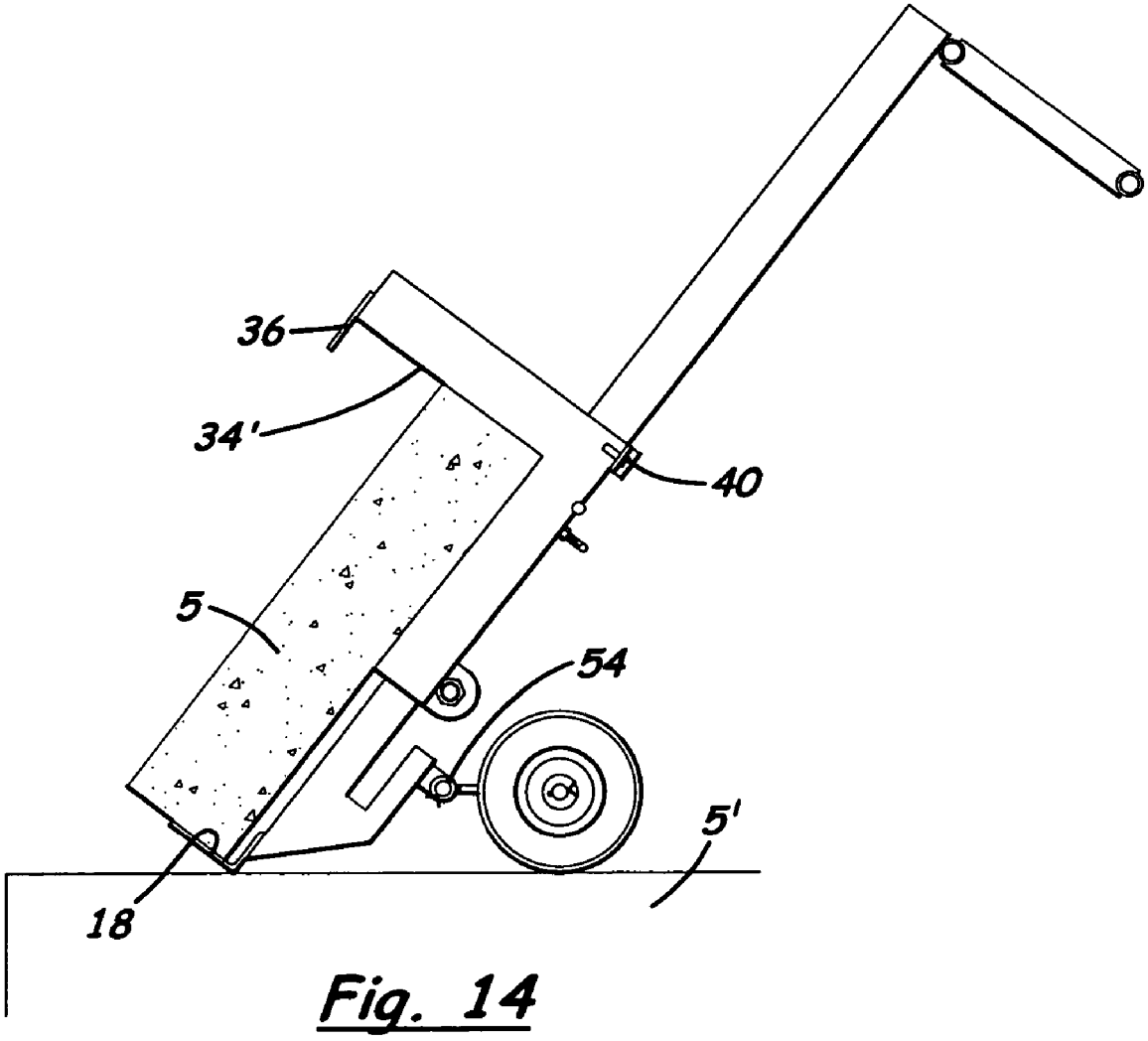
FIG. 14 shows the preferred embodiment of the present invention after the jaw has been lowered to the lowest position possible to hold the concrete slab.

During the process of pivoting the lifter 10 from the position in FIG. 12, the wheels 50 may pivot towards an upward position, as shown in FIG. 13A. When the concrete slab lifter 10 and concrete slab 5 are lifted upward, the wheels 50 press against the adjacent concrete slab 5' that is still on the ground 1, causing the wheels 50 to pivot upward. After the wheels 50 have pivoted to the upward position, the wheels 50 become the fulcrum for continued pivoting of the concrete slab lifter 10 and the concrete slab 5; the bottom ends of the concrete slab lifter 10 and the concrete slab 5 are lifted to the extent that they clear the edge and top of the adjacent slab 5, as shown in FIG. 13B. The concrete slab lifter 10 may then be wheeled farther onto the surrounding concrete. If the wheels 50 did not remain on the adjacent concrete slab 5' during these steps, then the concrete slab lifter 10 would be stuck in the hole created by lifting the concrete slab 5, and could be removed only by strenuous pulling. With the wheels 50 pivoted to an upward position, the wheels 50 are already on the second concrete slab 5 when the concrete slab lifter 10 is in an upright position; if the wheels 50 did not pivot, then the wheels 50 would be on the ground 1, and the concrete slab lifter 10 would have to be pulled up onto the second concrete slab 5. Having the wheels 50 in their upward position also allows the concrete slab lifter 10 to be moved with the concrete slab 5 more nearly parallel to the ground 1—the wheels 50 are closer to the center of gravity of the combination of concrete slab lifter 10 and concrete slab 5, improving the operator's control. Also, the handle 20 may be made to swivel one-hundred eighty degrees so that when the concrete slab lifter 10 is tilted back, as shown in FIG. 13B, the handle 20 faces away from the ground, enabling the operator to grasp the handle 20 without bending forward. With the concrete slab lifter 10 tipped back so that the concrete slab is nearly parallel to the ground 1, the bottom of the concrete slab, which was previously embedded in the ground 1, faces up, reducing the amount of dirt that will fall off of the concrete slab 5 and into the workspace.

Figure 15:
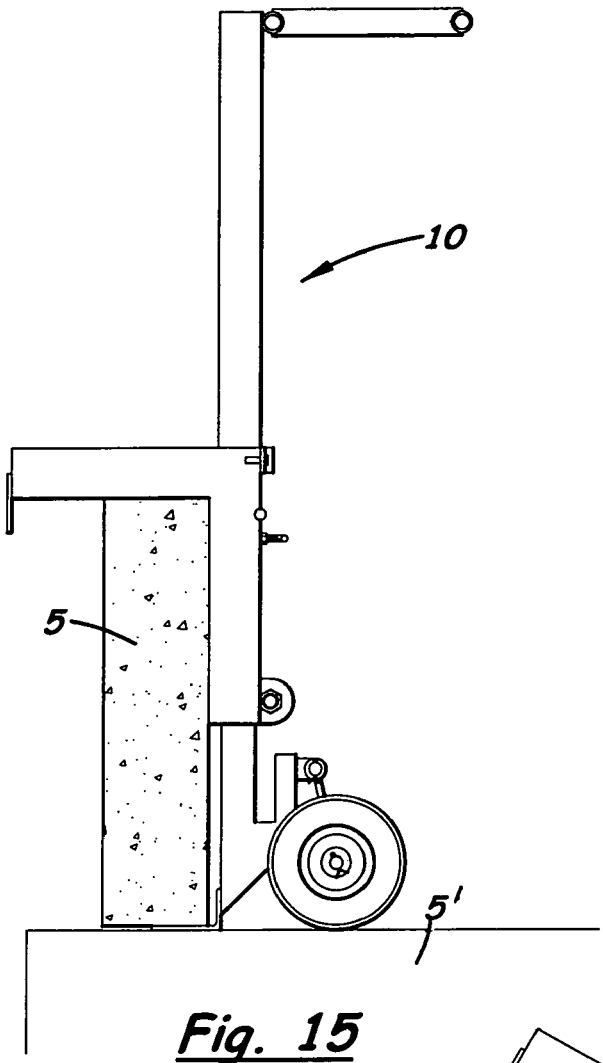
FIG. 15 shows the preferred embodiment of the present invention after the jaw has been lowered to the lowest position possible to hold the concrete slab and after the preferred embodiment has been tilted forward again to allow the wheels to pivot back to their lowered position.

With the concrete slab lifter 10 in the upright position, gravity will cause the wheels 50 to pivot back to a lowered position, as shown in FIG. 15. Optionally, the set screw 13 may be loosened to cause the central support 12 to shorten and the second portion 34 to move toward the base plate 18, causing the inner surface 34' of the second portion 34 to lay flush on the concrete slab 5. The set screw 13 may then be tightened, securing the concrete slab 5 in the concrete slab lifter 10.

Figure 16:
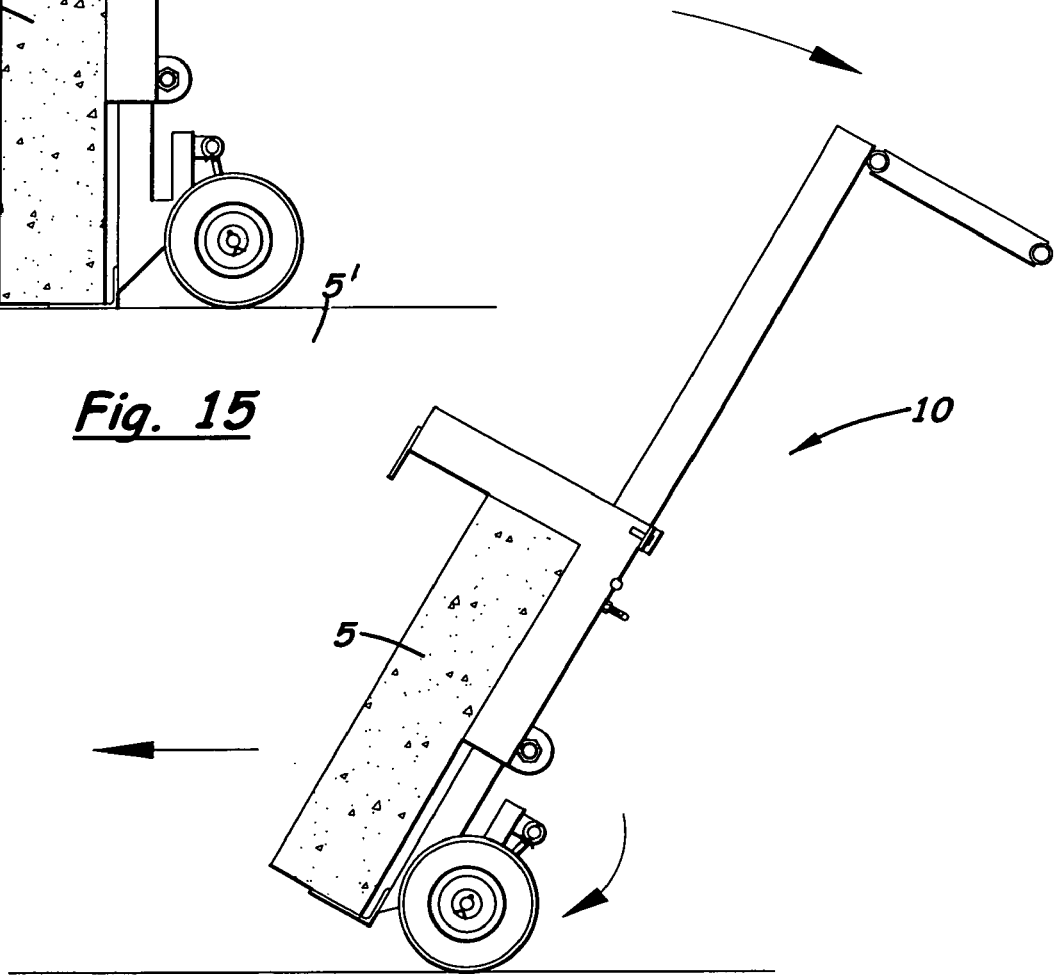
FIG. 16 shows the preferred embodiment of the present invention as it is being used to transport a concrete slab from one location to another.
Figure 17:
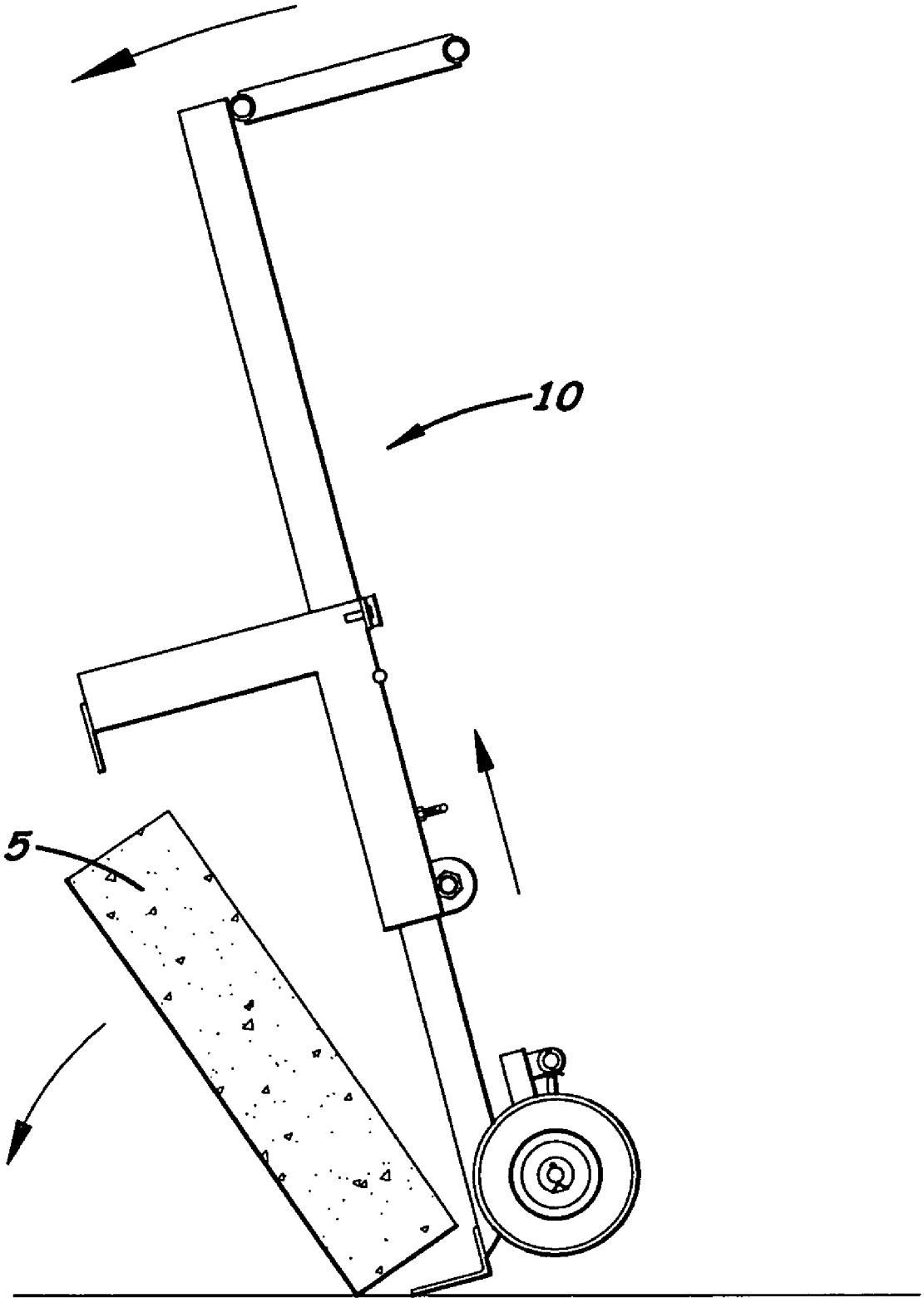
FIG. 17 shows the preferred embodiment of the present invention after it has been tilted forward and the jaw raised to allow the concrete slab to fall forward.

If the concrete slab lifter 10 were simply tilted backward from its upright position with the wheels 50 in their lowered position, then the wheels 50 might pivot upward. To prevent this, the operator preferably places his foot on the kickstop 53 while tilting the concrete slab lifter 10 backward from the position shown in FIG. 15. This keeps the wheels 50 in their lowered position. At this point, the concrete slab lifter 10 may be used in its upright position to transport concrete slabs 5, as shown in FIG. 16. The concrete slab 5 can be released by lifting the jaw 30 and tilting the concrete slab lifter 10 forward, as shown in FIG. 17.

This embodiment could also be used to pick up preformed pieces of concrete, such as, for example, those manufactured for stepping stones.

The preferred embodiment requires no outside power source, and will work in confined areas. One operator can remove concrete slabs without help in most cases. Thus, labor requirements are reduced. There are also fewer injuries using the concrete slab lifter 10 than lifting concrete slabs by hand. Less dirt and debris are left on the job site, leaving less to clean up. The length of the central support 12 provides greater leverage for larger, heavier pieces. The concrete slab lifter 10 is able to lift and hold concrete slabs 5 with a single jaw 30 because the jaw 30 clamps the concrete slab 5 tightly against the bottom plate 18.

It is envisioned that a larger variant of the present invention could be used in combination with an outside power source, such as a crane or backhoe, to lift larger slabs of concrete, such as slabs that are ten feet wide by ten feet long. This embodiment would still utilize the combination of jaw 30 and central support 12 to grasp the slab, but would not need benefit of torque created by a relatively long central support 12 because the lifting force would be supplied by the crane or backhoe.

Although this invention has been described above with reference to particular means, materials and embodiments, it is to be understood that the invention is not limited to these disclosed particulars, but extends instead to all equivalents within the scope of the following claims.

I claim:

1. A concrete slab lifter comprising:

a central support;

a bottom plate extending from the central support;

a pair of wheels connected to the central support; and a jaw;

wherein the jaw is adapted to move toward and away from the plate in a direction parallel to the central support; and wherein the jaw comprises:

a first portion which is pivotally connected to the central support and is adapted to pivot and lock into a position where the first portion has a longitudinal axis which is parallel to a longitudinal axis of the central support;

a second portion connected to the first portion; and a tooth connected to the second portion, said tooth extending parallel to the first portion; and wherein the tooth is a sharpened metal plate.

2. The concrete slab lifter of claim 1 further comprising a handle connected to the central support.

3. The concrete slab lifter of claim 1 wherein all the components of the concrete slab lifter except the wheels are made of metal.

4. The concrete slab lifter of claim 3 wherein the tooth extends from the second portion at least one inch and the tooth is no more than half an inch thick.

5. The concrete slab lifter of claim 4 wherein the bottom plate extends generally perpendicularly from the central support.

6. The concrete slab lifter of claim 5 wherein the first portion is between four-and-one-half inches and thirteen inches long.

7. The concrete slab lifter of claim 6 wherein the wheels are adapted to pivot about a hinge connected to the central support.

8. The concrete slab lifter of claim 6 wherein the tooth extends perpendicularly to the bottom plate when the jaw is locked.

9. The concrete slab lifter of claim 6 wherein the second portion extends perpendicularly to the first portion.

10. The concrete slab lifter of claim 6 wherein the second portion has an inner surface for facing a slab being lifted, wherein said inner surface is generally flat and perpendicular to the central support when the jaw is locked.

11. A concrete slab lifter comprising:

a central support;

a bottom plate extending from the central support;

a pair of wheels connected to the central support; and a jaw;

wherein the jaw is adapted to move toward and away from the plate in a direction parallel to the central support;

wherein the jaw comprises:

a first portion which is pivotally connected to the central support and is adapted to pivot and lock into a position where the first portion has a longitudinal axis which is parallel to a longitudinal axis of the central support;

a second portion connected to the first portion; and a tooth connected to the second portion, said tooth extending parallel to the first portion; and wherein the jaw is adapted to move toward and away from the bottom plate in a direction parallel to the central support by being attached to a first portion of the central support that telescopes relative to a second portion of the central support.

12. The concrete slab lifter of claim 11 wherein said first portion is pivotally connected to the central support at a position that is in the range of ⅓–⅔ of the way between the bottom plate and the second member when the first portion is locked to the central support.

13. A concrete slab lifter comprising:

a central support;

a bottom plate extending from the central support;

a pair of wheels connected to the central support; and a jaw;

wherein the jaw is adapted to move toward and away from the plate in a direction parallel to the central support;

wherein the jaw comprises:

a first portion which is pivotally connected to the central support and is adapted to pivot and lock into a position where the first portion has a longitudinal axis which is parallel to a longitudinal axis of the central support;

a second portion connected to the first portion; and a tooth connected to the second portion, said tooth extending parallel to the first portion, wherein said first portion is pivotally connected to the central support at a position that is in the range of ⅓–⅔ of the way between the bottom plate and the second member when the first portion is locked to the central support; and wherein the wheels are pivotally connected to the central support so that the wheels pivot toward the bottom plate to be in a lowered position near the bottom plate and pivot away from the bottom plate to be in a raised position near the position of pivotal connection of said jaw.

14. The concrete slab lifter of claim 11 comprising only a single jaw.

15. A concrete slab lifter comprising:

a central support;

a bottom plate extending from the central support;

a pair of wheels connected to the central support; and a jaw;

wherein the jaw is adapted to move toward and away from the plate in a direction parallel to the central support;

wherein the jaw comprises;

a first portion which is pivotally connected to the central support and is adapted to pivot and lock into a position where the first portion has a longitudinal axis which is parallel to a longitudinal axis of the central support;

a second portion connected to the first portion; and a tooth connected to the second portion, said tooth extending parallel to the first portion; and wherein the tooth is a plate having a sharpened distal edge.

16. The concrete slab lifter of claim 11 wherein said first portion ranges in length from 6–32 inches and said second portion ranges in length from 4.5–13 inches.

17. A slab lifter for lifting and transporting a slab having a top surface, a bottom surface, and opposing end surfaces, the slab lifter comprising:

a central support having a first end and a second end;

wheels connected to the central support near the second end;

a bottom plate extending from the central support near the second end;

a generally U-shaped jaw having an elongated first portion being pivotally connected to the central support at a jaw pivot and extending toward the first end of the central support, a second portion extending from the first portion generally transverse to the central support longitudinal axis, and a tooth portion extending from the second portion to be generally perpendicular to the bottom plate;

wherein the jaw is pivotal to move the second portion toward the bottom plate so that the second portion and the bottom plate are configured to clamp said opposite ends of a slab and so that the tooth portion is configured to extend along said bottom surface of the slab near one of the said opposing ends of the slab.

18. The slab lifter as in claim 17 wherein the bottom plate is substantially planar and is not adapted to contact said bottom surface of the slab.

19. The slab lifter as in claim 17 comprising a lock that holds the jaw in a position wherein the second portion is parallel to the bottom plate and that prevents the jaw from pivoting relative to the central support.

20. The slab lifter as in claim 17 wherein said wheels are pivotally connected to the central support and moveable from a position nearer said second end to a position nearer said first end.

* * * * *